US005502469A

United States Patent [19]

Watanabe

[11] Patent Number: 5,502,469

[45] Date of Patent: Mar. 26, 1996

[54] INK JET RECORDING APPARATUS WITH DETECTION OF RATE OF TEMPERATURE

[75] Inventor: Kenjiro Watanabe, Tokyo, Japan

[73] Assignee: Canon Kabushiki Kaisha, Tokyo, Japan

[21] Appl. No.: 293,417

[22] Filed: Aug. 22, 1994

Related U.S. Application Data

[63] Continuation of Ser. No. 987,246, Dec. 7, 1992, abandoned, which is a continuation of Ser. No. 653,299, Feb. 11, 1991, abandoned.

[30] Foreign Application Priority Data

Feb. 13, 1990 [JP] Japan ..... 2-31730

[51] Int. Cl.[6] ..... B41S 29/38; B41S 2/365

[52] U.S. Cl. ..... 347/14; 347/194

[58] Field of Search ..... 347/9, 17, 23, 347/194, 14; 346/76 PH

[56] References Cited

U.S. PATENT DOCUMENTS

| | | | |
|---|---|---|---|
| 4,250,512 | 2/1981 | Kattner et al. | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,518,973 | 5/1985 | Tazaki | 346/140 R |
| 4,550,327 | 10/1985 | Miyakawa | 346/140 R |
| 4,558,333 | 12/1985 | Sugitani et al. | 346/140 R |
| 4,577,203 | 3/1986 | Kawamura | 346/140 R |
| 4,626,875 | 12/1986 | Hara et al. | 346/140 R |
| 4,636,812 | 1/1987 | Bakewell | 346/76 PH |
| 4,660,056 | 4/1987 | Yokoi | 346/140 R |
| 4,719,472 | 1/1988 | Arakawa | 346/140 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | | |
|---|---|---|---|
| 0353925 | 7/1990 | European Pat. Off. | 346/140 R |
| 56-146763 | 11/1981 | Japan . | |
| 0155960 | 9/1983 | Japan | 346/140 R |
| 59-123670 | 7/1984 | Japan . | |
| 59-138461 | 8/1984 | Japan . | |
| 61-272811 | 12/1986 | Japan . | |
| 62-087354 | 4/1987 | Japan . | |
| 2169856 | 7/1986 | United Kingdom . | |

OTHER PUBLICATIONS

Drake, "Ink Temperature Control for Continuous Ink Jet Using Thin Film Resistors" *Xerox Discl. Jour.*, vol. 13, No. 3, May/Jun. 1983.

*Primary Examiner*—Benjamin R. Fuller
*Assistant Examiner*—David Yockey
*Attorney, Agent, or Firm*—Fitzpatrick, Cella, Harper & Scinto

[57] ABSTRACT

In a liquid ejection recording apparatus provided with a liquid ejection recording head having an orifice for ejecting liquid and an electricity-heat conversion member for generating thermal energy used for ejecting the liquid, the apparatus includes a temperature detecting unit for detecting a change in the temperature of the liquid ejection recording head over time, and a control unit for controlling the recording head and/or liquid ejection recording apparatus in accordance with the temperature change of the recording head detected by the detecting unit.

8 Claims, 10 Drawing Sheets

INK JET RECORDING APPARATUS WITH DETECTION OF RATE OF TEMPERATURE

This application is a continuation of application Ser. No. 07/987,246 filed Dec. 7, 1992, now abandoned and which was a continuation of application Ser. No. 07/653,299 filed Feb. 11, 1991, also abandoned.

BACKGROUND OF THE INVENTION

1. Field of the Invention

The present invention relates to a liquid ejection recording apparatus and control method, and more particularly to a liquid ejection recording apparatus and control method wherein information is recorded using thermal energy generated by an electricity-heat conversion member.

2. Description of Related Art

According to a liquid ejection recording method, recording liquid ejected by various methods is attached to a recording medium such as paper.

As recording apparatus using such a recording method, there is known a recording method which uses thermal energy as the energy for ejecting liquid, This method facilitates the use of a number of orifices at high density.

A liquid ejection recording apparatus using thermal energy as the energy for ejecting liquid has a record head generally constructed of orifices for ejecting heated recording liquid, and electricity-heat conversion members for heating recording liquid upon application of electrical signals.

In such liquid ejection recording apparatus, there occur in rare cases defective ejection or non-ejection of liquid because of bubbles from a recording liquid supply system, the surface of an orifice becoming wetted with recording liquid, or other reasons, thereby lowering the recording quality, It is therefore necessary to detect such defective ejection or non-ejection as soon as possible and carry out a recovery operation.

SUMMARY OF THE INVENTION

The present invention has been made in consideration of the above circumstances, and aims at providing an improved liquid ejection recording apparatus and control method.

It is an object of the present invention to provide a liquid ejection recording apparatus and control method capable of minimizing deterioration of the printing quality even if an abnormal condition such as defective ejection or apparatus trouble occurs during a printing operation.

It is a further object of the present invention to provide a liquid ejection recording apparatus and control method with high safety against the case where an abnormal condition such as defective ejection or apparatus trouble occurs during a printing operation.

It is a still further object of this invention to provide a liquid ejection recording apparatus and control method wherein if the temperature rise rate of a recording head during a printing operation becomes in excess of a preset value, it is judged as defective ejection, and a recovery operation or the like is automatically performed. Since the recording apparatus is automatically stopped and the recovery operation is performed even if an operator does not recognize defective ejection and deteriorated printing quality, it is possible to minimize deterioration of printing quality.

It is another object of the present invention to provide a recording apparatus and control method having very high safety wherein heating by the recording apparatus is automatically stopped when the temperature of the recording head rises abnormally because of a trouble of the temperature control circuit of the recording head even if an operator does not recognize it.

It is a still further object of the present invention to provide a liquid ejection recording apparatus having a liquid ejection recording head constructed of an orifice for ejecting liquid and an electricity-heat conversion member for generating thermal energy used for ejecting the liquid, the apparatus comprising temperature detecting means for detecting the temperature of the liquid ejection recording head, and a control unit for controlling the recording head and/or liquid ejection recording apparatus in accordance with the temperature change of the recording head detected by the detecting means.

It is a further object of the present invention to provide a control method for a liquid ejection recording apparatus having a recording head with an orifice for ejecting liquid and a drive unit for driving the recording head, the method comprising detecting the temperature of the recording head, and stopping driving the recording head if the temperature rise rate is higher than a preset temperature rise rate.

The above and other objects of the present invention will become apparent from the following detailed description when read in conjunction with the accompanying drawings.

DETAILED DESCRIPTION OF THE PREFERRED EMBODIMENTS

The present invention will be described in detail below with reference to the accompanying drawings.

Figure 5:
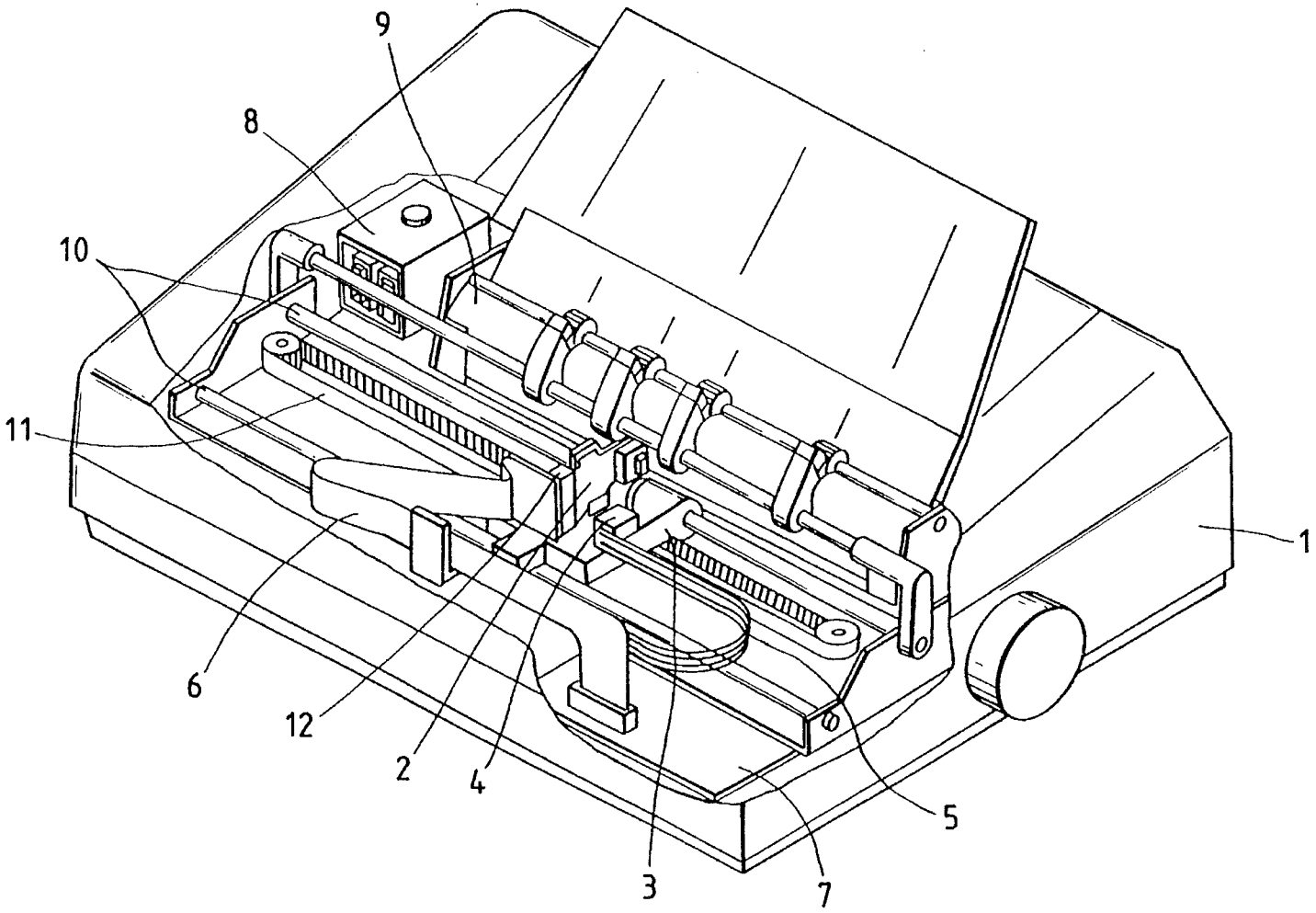
FIG. 5 is a perspective view schematically showing an example of the structure of a liquid ejection recording apparatus applying the present invention.

FIG. 5 is a schematic illustration in perspective of an example of the structure of a liquid ejection recording apparatus having a liquid ejection recording head which uses thermal energy as the liquid ejection energy.

A liquid ejection recording head (recording head) 2 is mounted on a carriage 3 which is scanned right and left along a slide shaft 10 by a carriage drive motor (CR motor, not shown) and a carriage drive belt 11. An electrical signal from a main board 7 is supplied to the recording head 2 via a flexible printed circuit (FPC) wiring 6. Recording liquid in an ink cartridge (not shown) within the liquid ejection recording apparatus 1 is supplied to the liquid ejection recording head 2 via a tube 5 and a sub-ink tank 4 on the carriage 3.

An absorption recovery apparatus (absorption recovery mechanism) 8 is mounted on the liquid ejection recording head 2 at the home position of the carriage 3 of the liquid ejection recording apparatus 1, because defective ejection occurs in rare occasions due to entered bubbles, attachment of recording liquid to the surface of an orifice, and the like. A recording medium is fed onto a platen 9 by a paper feed motor (LF motor, not shown). Information is recorded on the recording medium by moving the recording medium and scanning the recording head 2 right and left.

Figure 6:
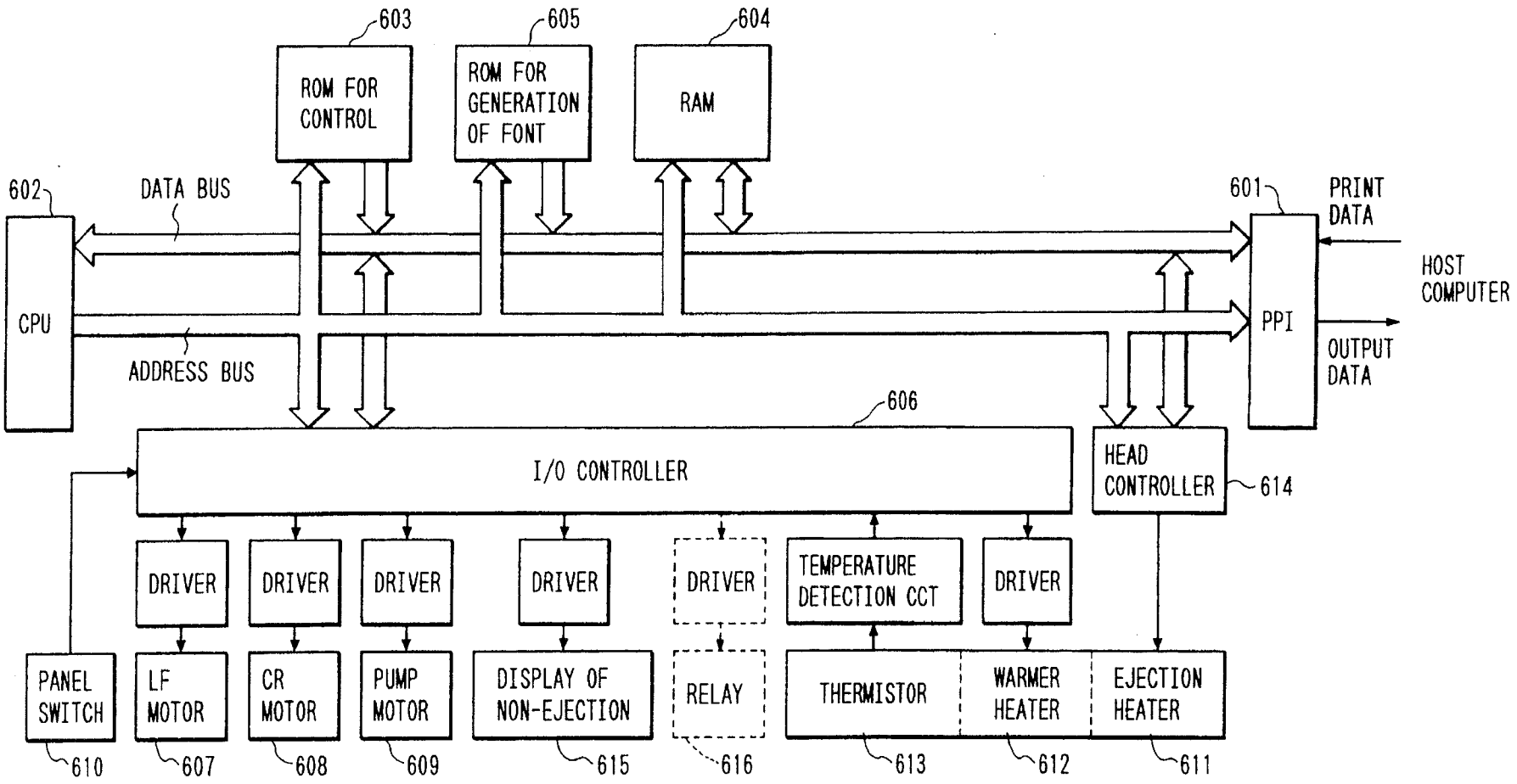
FIG. 6 is a block diagram showing an example of the structure of the control unit of the liquid ejection recording apparatus applying the present invention.

FIG. 6 is a block diagram showing an example of the structure of a control unit (main board 7) of the liquid ejection recording apparatus 1.

With this control unit, print data from a host computer for example is received, print data of one line is stored, and the recording head is controlled by a head controller to print the data.

First, a PPI (Programmable Peripheral Interface) 601 receives print data sent in parallel from a host computer of the recording apparatus of this embodiment, and sends the print data to a CPU 602. CPU 602 executes various procedures for the recording apparatus in accordance with the contents of a control ROM 605. RAM 604 is used as a line buffer memory for storing print data of several lines received by PPI 601. A font generator ROM 605 is stores fonts of print data. Control ROM 603 stores procedures to be executed by CPU 602. These memories are connected to an address bus and a data bus.

An I/O controller 606 is made of an IC dedicated to the control of a paper feed motor (LF motor) 607, a carriage drive motor (CR motor) 608, and an absorption recovery apparatus drive motor (pump motor) 609, to the data input/output control of a panel switch 610, to the control of a heat retaining heater 612 within the recording head 2, to the input control of temperature information from a temperature detecting means (thermistor) 613 within the recording head, and to other operations.

A head controller 614 is made of an IC dedicated to latch print data and print output time data, and sends print output to the recording head 611 in response to an instruction from CPU 602.

The recording head 611 ejects recording liquid in accordance with the print data and print output time data from the head controller 614, to thereby record the print data on the recording material.

Figure 7:
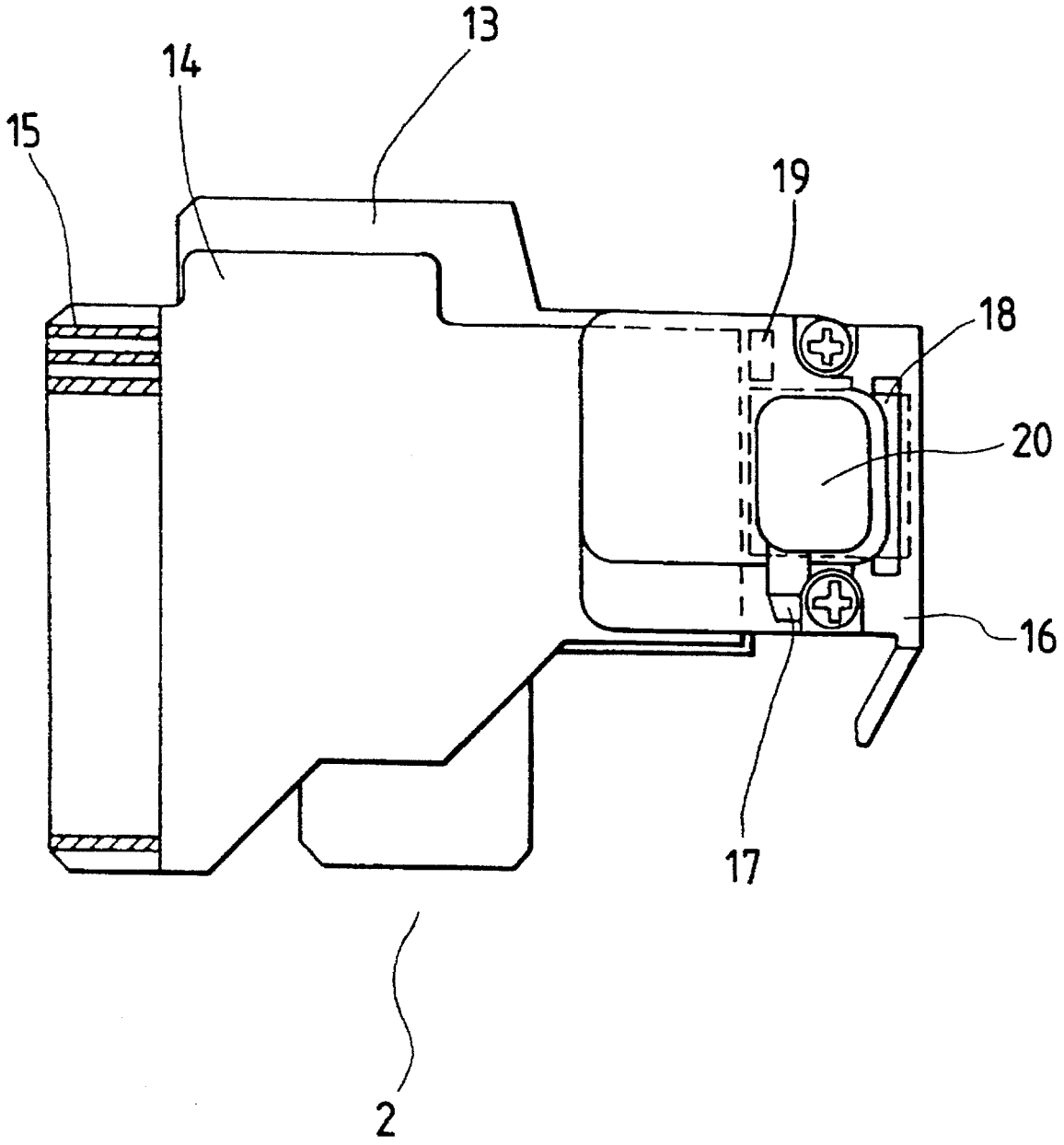
FIG. 7 is a side view schematically showing an example of the structure of a liquid ejection recording head unit applying the present invention.

FIG. 7 is a side view schematically showing an example of the structure of a liquid ejection recording head, particularly a recording head unit using heat as ejection energy. On a base plate 13, there are mounted a printed circuit board (PCB) 14, a thermistor 19 for detecting the temperature of the recording head, and an ejection element 18 constituted by an orifice for ejecting recording liquid, an electricity-heat conversion member, and a liquid chamber. Print data from FPC 6 is supplied to the ejection element 18 when a head connector 12 on FPC 6 is coupled to a connector 15 of the printed circuit board 14 electrically connected to the recording head.

Recording liquid is supplied to the ejection element 18 via an ink supply tube 17 and a liquid reservoir 20 integrally mounted within a holder 16 which protects the main part of the recording head.

Figure 8:
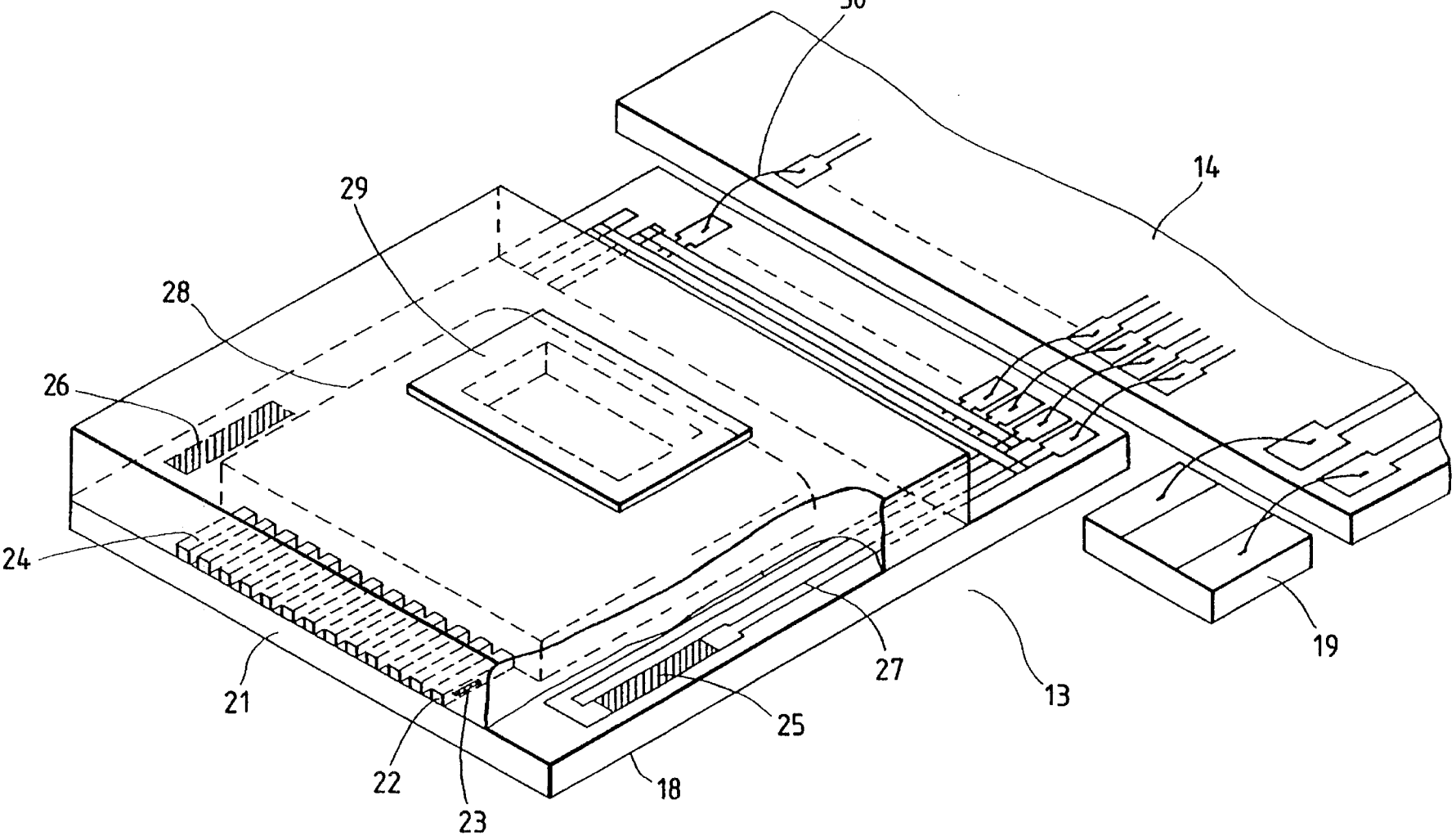
FIG. 8 is a perspective view schematically showing the main part of a liquid ejection recording head applying the present invention.

FIG. 8 is a schematic illustration of the main part of the recording head 2. The ejection element 18 is constructed of an electricity-heat conversion element 23 mounted on a Si substrate 21 for serving as an ejection energy generator, head heat retaining heaters 25 and 26 for heating the recording head and serving as another electricity-heat conversion member different from the ejection energy generator, an Al wiring 27 for transmitting power to the electricity-heat conversion element 23 and the heat retaining heater 25, a member 24 joined to the Si substrate 21, and a filter 29 joined to the member 24. The member 24 is formed with recesses constituting, when it is joined to the Si substrate 21, orifices 22, liquid paths communicating with orifices 22, and a liquid chamber 28 communicating with the liquid paths. The filter 29 is used for removing impurities such as dust contained in the liquid introduced into the liquid chamber 28. The member 24 is not limited as shown in FIG. 8, but it may take various configurations. Further, it is not limited to be formed integral as a whole, but it may be formed by discrete elements. For example, the wall portions of the liquid paths may be formed with a hardened film of photosensitive resin, and another plate member may be attached on the wall portions. The structure of the recording head may thus be changed as desired.

Electrical connection among the ejection element 18, thermistor 19 and printed circuit board 14 is made by wires (wire bonding).

In a liquid ejection recording apparatus using an electricity-heat conversion member for heating liquid and ejecting it out, the thermal energy generated by the electricity-heat conversion member (electricity-heat conversion element 23) is mostly (e.g., 50% or more) consumed in raising the temperature of liquid and ejecting several liquid droplets. The actual energy consumed for raising the temperature of the recording head is therefore several tens % of the remaining energy, because the heated liquid droplets are ejected out of the recording head and the heat transmitted to the substrate is dissipated out of it.

However, in case of a trouble of ejection, there occurs a case wherein liquid droplets are not ejected out and the thermal energy is not dissipated.

Figure 10:
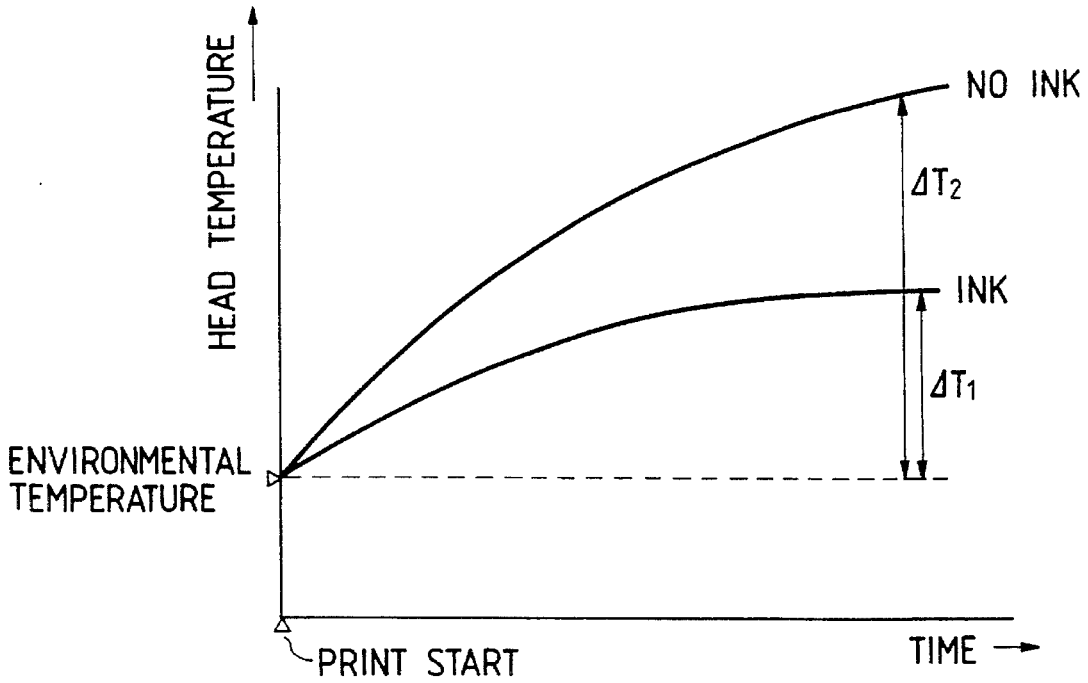
FIG. 10 is a graph showing a head temperature rise curve with and without ink within a recording head.

FIG. 10 shows an example of temperature rise when a print signal is supplied, with and without recording liquid (ink) being supplied to the recording head.

If ink is not being supplied (or if ink is not ejected out although it is being supplied), thermal energy will not be dissipated out of the recording head because liquid droplets are not ejected. Therefore, generated thermal energy is used almost 100% for raising the temperature of the recording head. Consequently, the head temperature rise T2 without ink becomes fairly high (in this example about two times) as compared with that T1 with ink.

The present invention uses the principle of a liquid ejection recording apparatus which ejects out liquid using the above-described thermal energy.

Figure 11:
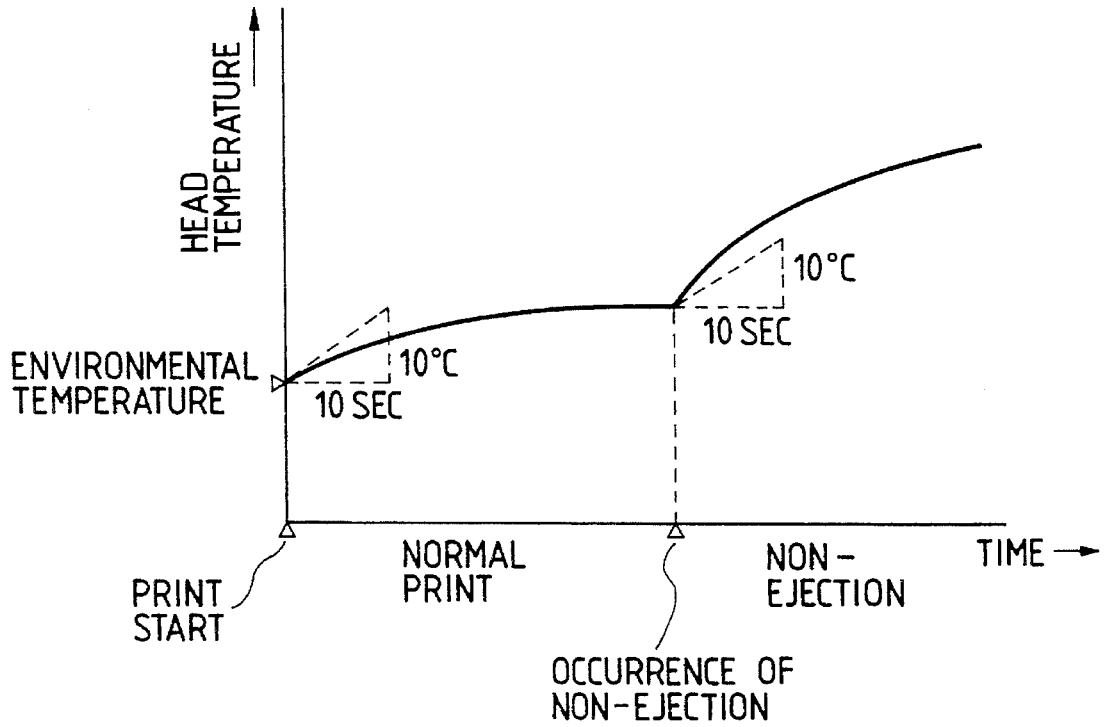
FIG. 11 is a graph used for explaining the present invention and showing a head temperature rise curve with non-ejection.

Specifically, the present invention uses a difference of temperature rise of a recording head between a normal printing operation and a non-ejection operation, as shown in FIG. 11. Assuming that the preset temperature rise rate is, for example, 10° C./10 seconds, the temperature rises at a smaller rate than this preset rate during the normal print, and at a larger rate during non-ejection. This difference is detected to perform various processes.

1st Embodiment

Figure 1:
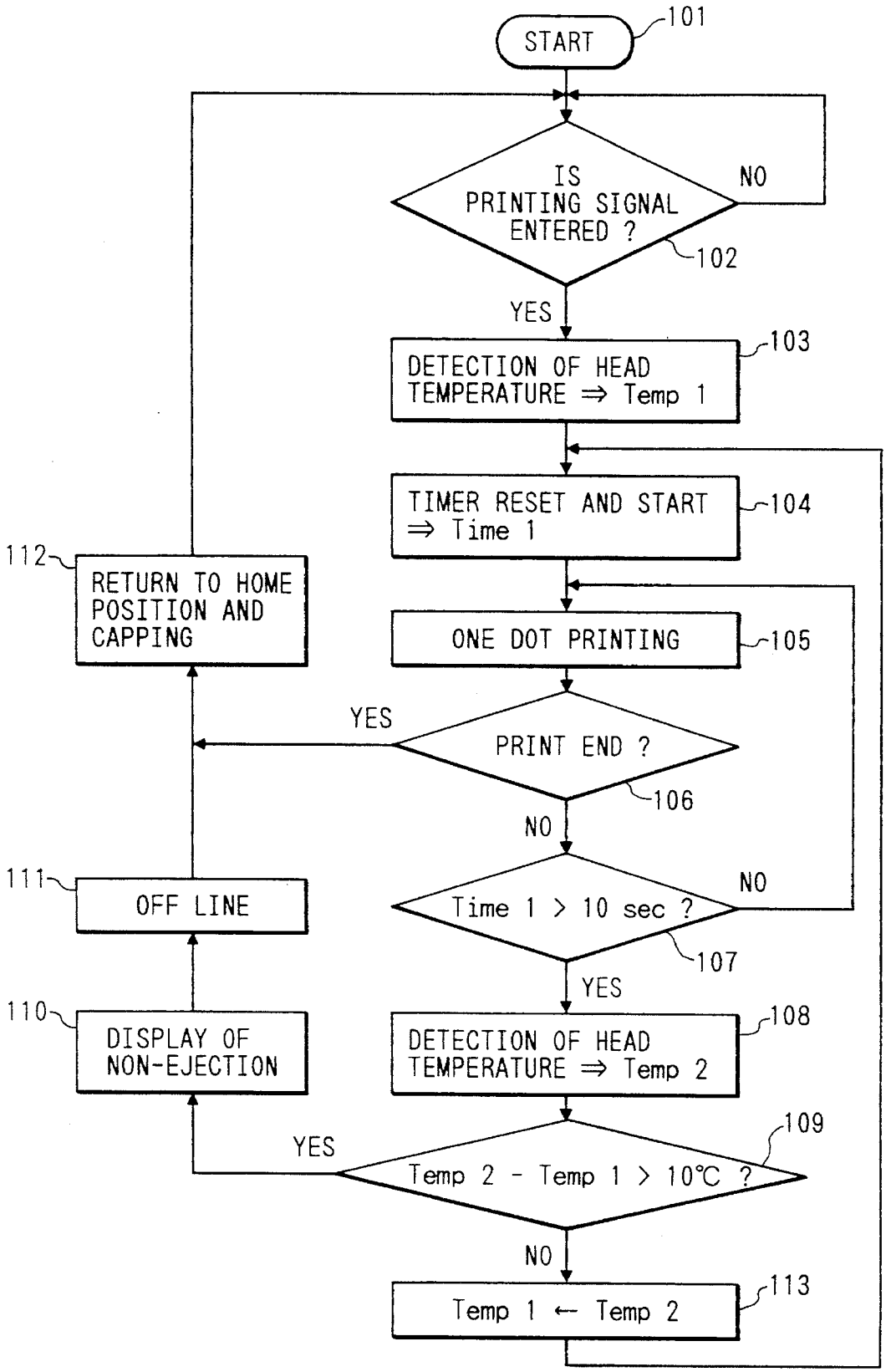
FIG. 1 is a flow chart illustrating a first embodiment of this invention.

FIG. 1 is a flow chart illustrating the control procedure of a first embodiment of this invention.

After turning on the apparatus power (step 101), it is checked if there is any printing signal (step 102). If a printing signal has been entered, the temperature of the recording head is detected and set as Temp 1 (step 103). Next, after resetting a timer, the contents thereof are counted and set as Time 1 (step 104). One dot is printed in accordance with the printing signal (step 105), and thereafter it is checked if the printed dot is the last, dot of the printing signal (step 106). If printing is not still completed, it is checked if the count time Time 1 is larger than 10 seconds (step 107). If the count time Time 1 is smaller than 10 seconds, the control returns to step 105 and repeats the above steps. If the Time 1 is over 10 seconds, the temperature of the recording head is detected and set as Temp 2 (step 108). It is checked if the value of Temp 2 subtracted by Temp 1 is equal to or higher than 10° C. (step 109). If this value is smaller than 10° C., Temp 2 is set as Temp 1 (step 113) to return to step 104 and repeat the above steps. If the value is equal to or higher than 10° C., it is judged as non-ejection so that an indication of non-ejection is displayed on a display 615 that informs an operator of the non-ejection condition (step 110) and the apparatus is made off-line.

Succeedingly, in order to eliminate a clogged state of the recording head or to protect the recording head, it is returned to the home position and capped (step 112). The control then returns to a stand-by state. If it is judged at step 106 that printing has completed, the control returns to step 112 to cap the recording head and protect it from a clogged state and the like.

In this embodiment, the temperature rise rate has been preset to 10° C./10 seconds, and if the temperature rise rate is higher than this value, it is judged as non-ejection.

An indication of non-ejection will not be effected during the normal print even if liquid is continuously ejected out of all orifices. On the other hand, if non-ejection occurs, the temperature rise rate becomes higher than the preset value so that recording is intercepted. Therefore, damage to the recording head due to excessive heating can be avoided. Furthermore, defective ejection can be detected at a earlier stage and the operation of the apparatus is stopped, thereby minimizing a waste of recording liquid and the like.

In the above embodiment, time is checked every time one .dot has been printed. Instead, the temperature of the recording head may be checked every one second, every one character, or every one predetermined print area, and if the temperature rise becomes equal to or higher than 10° C. per 10 seconds or per predetermined print time, then it may be considered as non-ejection while stopping the recording operation and indicating non-ejection.

Although the 10° C./10 seconds has been used as a reference value, obviously it may be set as desired in accordance with the characteristic of the recording head, and the characteristic and structure of the apparatus.

Furthermore, without setting Tamp 2 to Temp 1 at step 113, the control may be returned directly to step 103 to detect again Temp 1.

2nd Embodiment

In this embodiment, the temperature rise rate to be preset is determined in accordance with the contents of recording information, to thereby detect non-ejection more precisely. For example, the total number of dots per one printing line is counted to estimate a temperature rise during a normal printing and preset the temperature rise rate higher than the estimated value.

Figure 2:
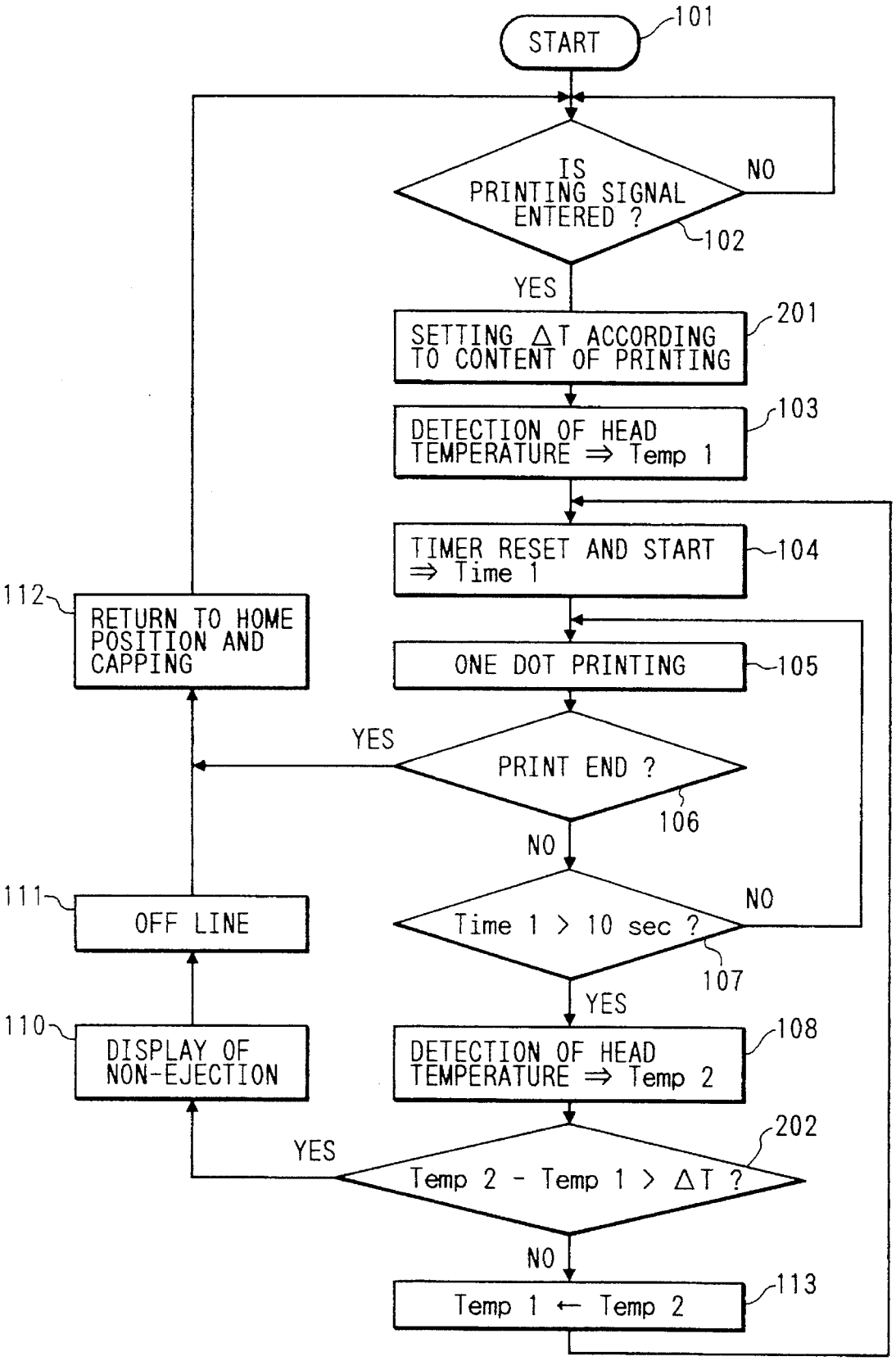
FIGS. 2, 3 and 4 are flow charts illustrating second to fourth embodiments of this invention, respectively.

FIG. 2 is a flow chart illustrating this embodiment.

The different points of this embodiment from the first embodiment are as follows. First, there is added a step 201 for setting ΔT in accordance with the printing contents after a printing signal is entered. Second, although 10° C. has been used as a reference at step 109 shown in FIG. 1, in this embodiment ΔT is used as a reference at step 202.

With this arrangement, non-ejection can be detected more precisely even if the recording density is low (even if the number of orifices used is small or even if the total number of orifices used is small).

3rd Embodiment

In this embodiment, in addition to the first embodiment, an automatic absorption recovery operation is carried out.

Figure 3:
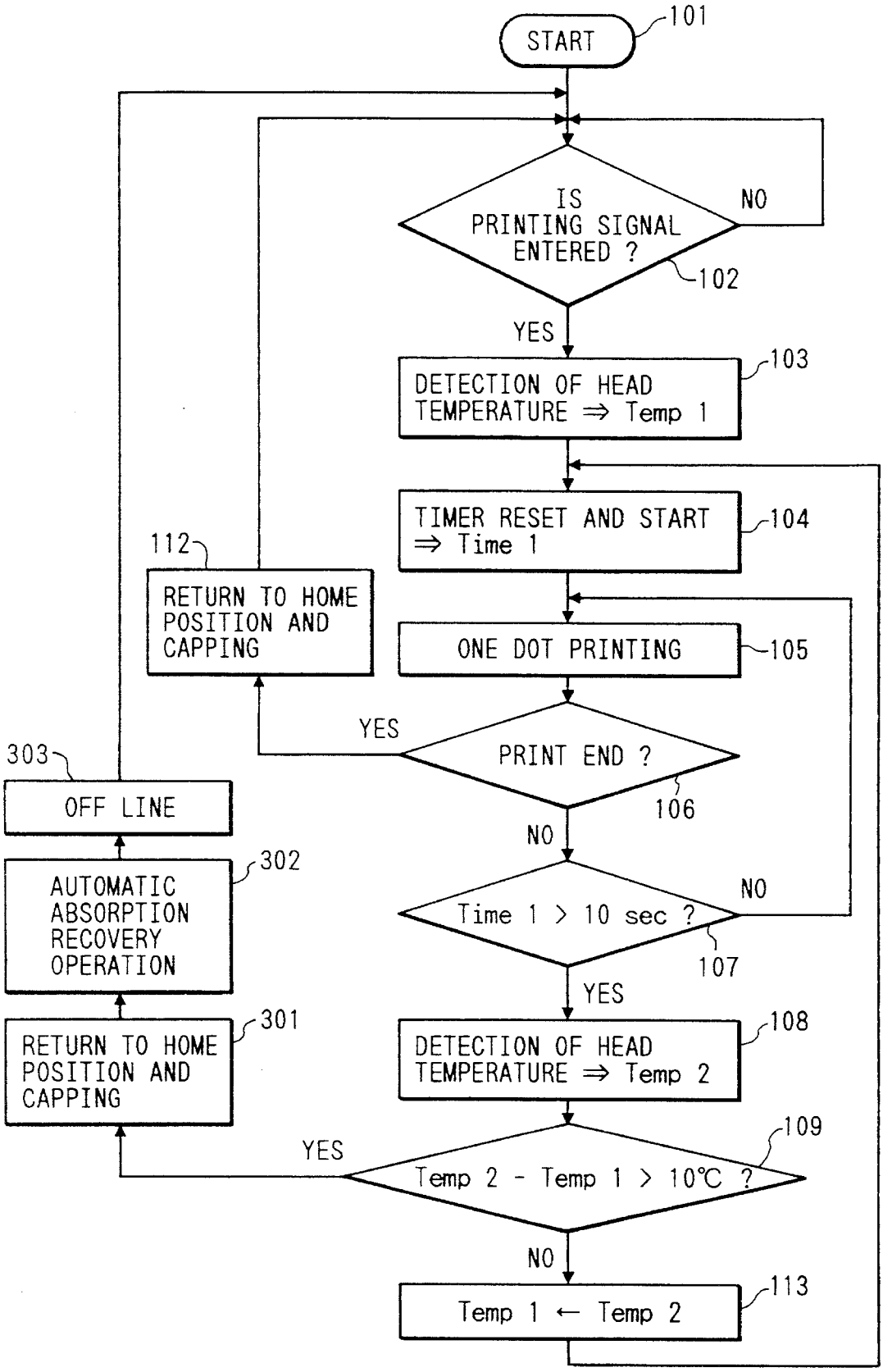

FIG. 3 is a flow chart illustrating this embodiment.

The different point of this embodiment from the first embodiment is as follows. In the first embodiment, if the temperature difference becomes equal to or higher than 10° C. at step 109, an indication of non-ejection is displayed, printing is stopped, and the recording head is capped. In this embodiment, however, if the temperature difference becomes equal to or higher than 10° C., printing is stopped, and the recording head is returned to the home position and capped (step 301). Succeedingly, a recovery operation is performed using an absorption recovery mechanism 8 (step 302) and the apparatus is made off-line (step 303).

With this arrangement, a recovery operation is automatically carried out when non-ejection occurs, thereby reliably preventing the recovery operation from being not executed when printing is resumed.

4th Embodiment

The recording characteristic of a liquid ejection recording apparatus, particularly the volume of an ejected liquid droplet, is influenced by the temperature of recording liquid. This may cause unevenness of the recording density. Accordingly, it has been controlled generally to maintain the temperature of the recording head constant. There is provided, within the recording head, temperature detecting means for detecting the temperature of the recording head, and a heat retaining heater for heating the recording head. In accordance with the temperature information from the temperature detecting means, the recording apparatus controls to turn on and off the power to the heat retaining heater.

Figure 9A:
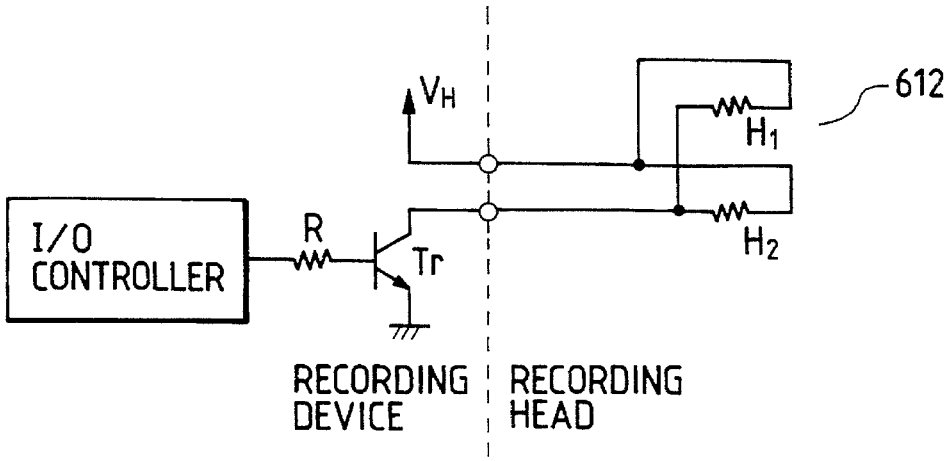
FIGS. 9*a*, 9*b*, and 9*c* are circuit diagrams of a drive circuit for a heat retaining heater for a recording head.

FIG. 9*a* is a circuit diagram showing an example of a heat retaining heater drive circuit. In this embodiment, two heat retaining heaters H1 and H2 are connected in parallel within the recording head. A transistor is used for driving the heat retaining heaters, and operates to turn on and off the heat retaining heaters.

Figure 9B:
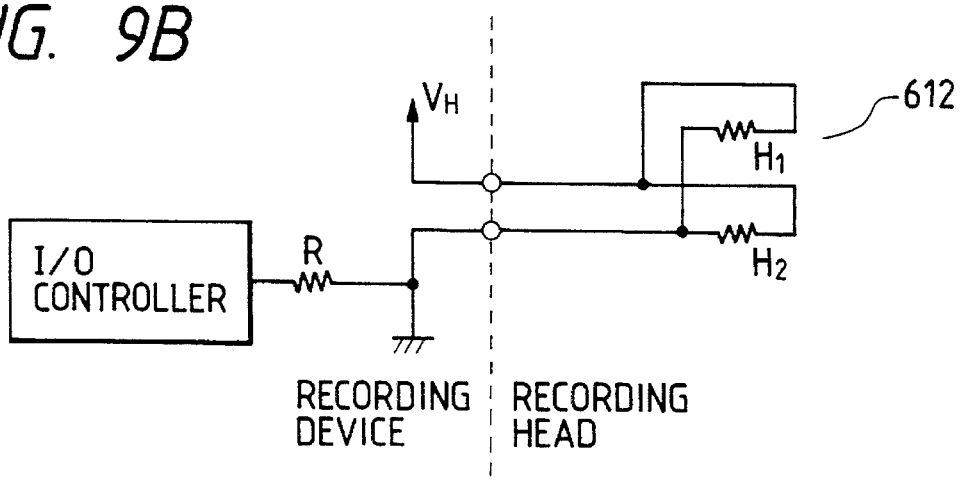

If the heat retaining heater driving transistor becomes defective and broken to be short-circuited to ground as shown in FIG. 9*b*, or if it becomes always turned on because of a failure of a control system of the recording apparatus, the heat retaining heaters continue to heat the recording head so long as a power source voltage Vh is supplied, i.e., until the main power to the recording apparatus is turned off. There occurs therefore a danger of excessive heating, breakage and the like of the recording head.

A preferred embodiment for solving this problem will be given below.

Figure 9C:
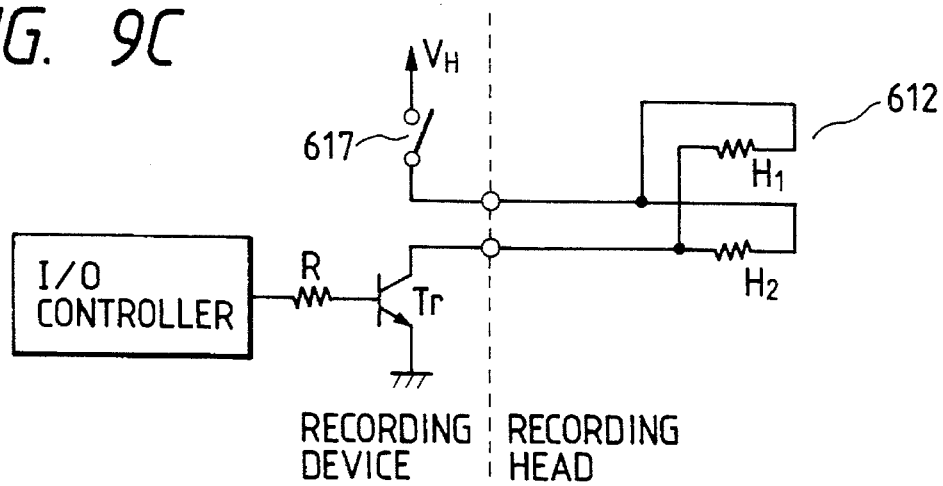

In this embodiment, as shown by a broken line in FIG. 6, a relay 616 is connected to the I/O controller, and the contacts 617 of the relay 616 are connected as shown in FIG. 9*c*. In this embodiment, in addition to the function of the third embodiment, if the temperature of the recording head exceeds 70° C., the relay 616 is driven to open the contacts 617 and hence turn off the recording head driving voltage Vh.

Figure 4:
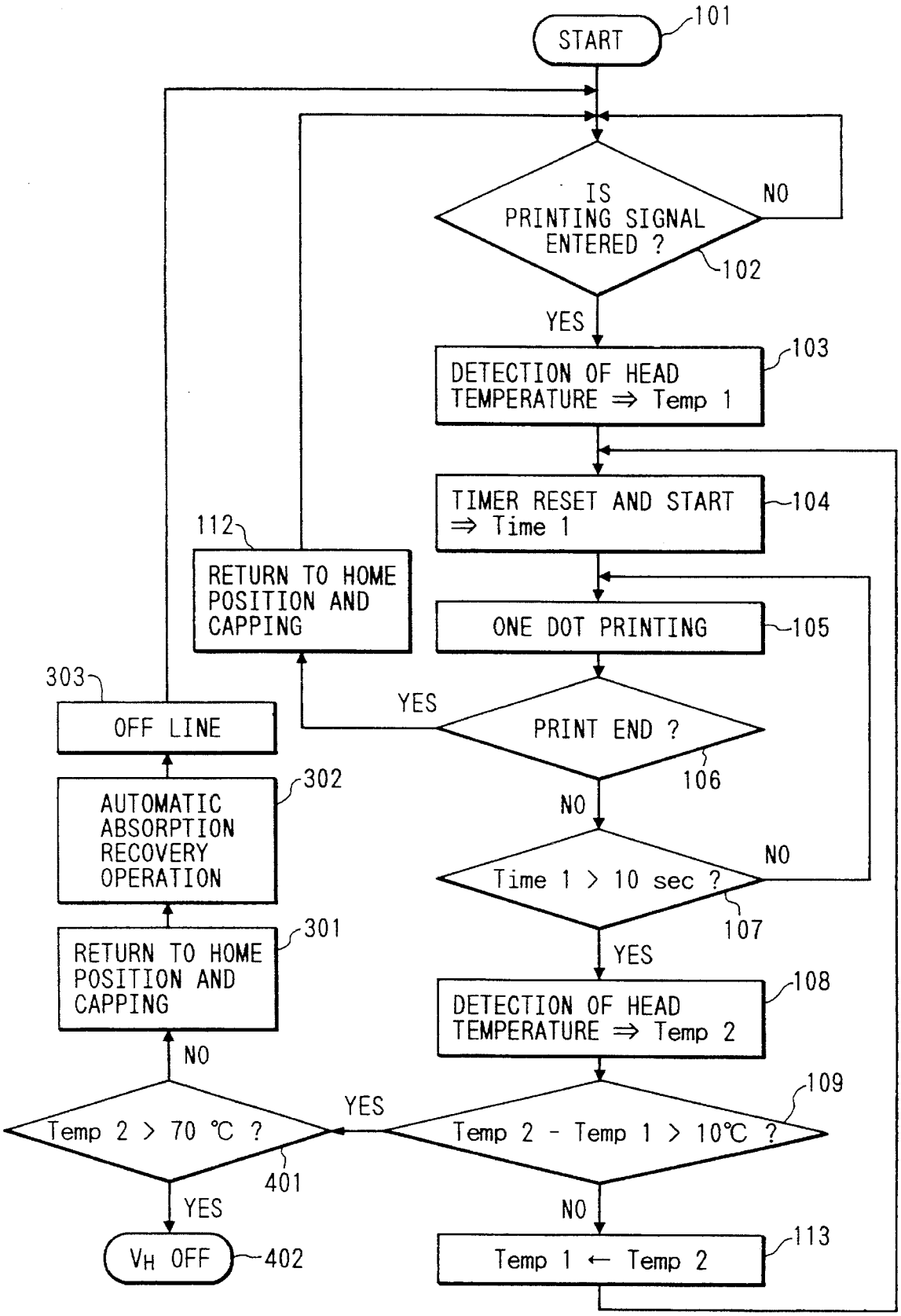

FIG. 4 is a flow chart illustrating this embodiment.

In this embodiment, in addition to the steps of the third embodiment, the following judgment step is added. Specifically, when the temperature difference becomes equal to or higher than 10° C., it is first checked if the temperature Temp 2 of the recording head is in excess of 70° C. (step 401). If not, the same steps as the third embodiment are executed. If in excess of 70° C., then the recording head driving voltage Vh is turned off or the power supply to the recording apparatus is stopped (step 402).

In this embodiment, if the temperature of the recording head rises to 70° C. or higher, it is considered that the heat retaining heaters have continued in their turned-on state because of trouble in the heat retaining heater driving circuit. Then, the recording head driving voltage Vh is turned off or the power supply to the recording apparatus is stopped, to thereby stop heating by the heat retaining heaters.

Obviously the temperature 70° C. may be set as desired in accordance with the characteristics and performances of the recording head and the apparatus. This temperature should be set to such a value higher than a temperature under which a normal printing is possible with all orifices of the recording head being continuously ejecting recording liquid.

According to this embodiment, an abnormal state of the recording head can be detected at an earlier stage, thereby providing an apparatus with much safety without giving fatal damages such as breakage of the recording head or the apparatus.

As described above, if the temperature rise rate exceeds a preset value, it is considered as defective ejection, and an indication of defective ejection and recovery operation are automatically carried out. As a result, even if defective ejection occurs during a printing operation, lowering the printing quality, and an operator does not recognize it, the recording apparatus automatically stops its printing operation and performs a recovery operation, thereby minimizing deterioration of printing quality.

Furthermore, even if the recording head temperature rises abnormally because of a failure of the temperature control circuit, and an operator does not recognize it, the recording apparatus automatically stops its heating, thereby providing a recording apparatus and control method with high safety.

As described above, the present invention is particularly advantageous if it is applied to a bubble jet type recording head and apparatus of an ink jet recording type.

The typical structure and principle of the bubble jet type are preferably those disclosed, e.g., in the specifications of U.S. Pat. No. 4,723,129 and U.S. Pat. No. 4,740,796. This principle is applicable to both a so-called on-demand type and a continuous type. The on-demand type is particularly useful. With this type, at least one drive signal corresponding to record information is applied to an electricity-heat conversion member disposed at a liquid (ink) containing sheet or liquid path so that a rapid temperature rise in excess of nucleate boiling is provided. Thermal energy generated by the electricity-heat conversion member causes film boiling at the thermal acting surface of the recording head so that a bubble in one-to-one correspondence with the drive signal will be formed within the liquid (ink). In response to a growth/contraction of a bubble, a liquid (ink) is ejected out of an orifice to form one droplet. It is more preferable that a pulse signal is used for this drive signal, since a bubble can be grown and contracted rapidly and properly, and a liquid (ink) can be ejected out with good response characteristics. As this pulse-like drive signal, it is preferable to use such a signal as disclosed in the specifications of U.S. Pat. No. 4,463,359, and U.S. Pat. No. 4,345,262. Excellent printing can be made if there are adopted the conditions described in the specification of U.S. Pat. No. 4,313,124 regarding the temperature rise rate at the heat acting surface.

The structure of the recording head used in this invention, includes not only a combination of structures of orifices, liquid paths, electricity-heat conversion members disclosed in the above-mentioned specifications, but also the structure having the heat acting surface disposed in a bending area as disclosed in the specifications of U.S. Pat. No. 4,558,333, and U.S. Pat. No. 4,459,600.Further, this invention may advantageously adopt the structure disclosed in Japanese Laid-open Publication No. 59-125670 wherein a slit shared by a plurality of electricity-heat conversion members is used as an orifice, or the structure disclosed in Japanese Laid-open Publication No. 59-138461 wherein an opening for absorbing a pressure wave of heat energy is formed facing an orifice.

A full line type recording head having a length same as the width of a maximum recording medium the apparatus allowed to print, may also be used, with the above-described advantageous effects being further enhanced. In this case, such a recording head may be constructed of a plurality of recording heads disclosed in the above-mentioned specifications, or may be constructed of a single integral recording head.

This invention is also applicable to a chip type recording head which is detachably mounted on the apparatus for electrical connection and ink supply, and to a cartridge type recording head having a built-in ink supply.

Additional mounting of recovery means for a recording head, auxiliary means, and the like as described previously is preferable since the advantageous effects of this invention can be reliably ensured. Such additional means include capping means, cleaning means, pressurizing or absorbing means, respectively for a recording head, and auxiliary heating means for an electricity-heat conversion member, a different heating element, or a combination thereof. It is also effective for stable printing to provide an auxiliary ejection mode different from an ejection for printing.

Furthermore, the present invention is particularly useful not only for an apparatus having a recording mode with only a main color such as black, but also for an apparatus having a recording mode with different multiple colors or compound full colors using either an integral recording head or a plurality of recording heads.

I claim:

1. An ink jet recording apparatus comprising:

recording means for recording information, said recording means having a plurality of ink orifices and a plurality of energy generation elements, each of said energy generation elements generating energy for ejecting an ink droplet in accordance with image data and which said energy generation element is associated with a corresponding ink orifice;

detection means for detecting a temperature of said recording means at a beginning and an end of a predetermined time interval during a recording operation to output detection values related to the temperature of the recording means at the beginning and the end of the predetermined time interval during the recording operation;

power providing means for providing electric power to said recording means;

control means receiving the detection values for controlling said power providing means in accordance with both a temperature variation during the predetermined time interval and the temperature detected at the end of the predetermined time interval, the temperature variation being related to the temperature at the beginning and the end of the predetermined time interval, wherein when the temperature variation exceeds a reference value, and in addition, when the temperature detected at the end of the predetermined time interval exceeds a predetermined temperature associated with an abnormal temperature rise of said recording means, said predetermined temperature being greater than said temperature variation, said control means controls said power providing means so as to stop the providing of electric power to said recording means, while when the temperature variation does not exceed the reference value and when the temperature detected at the end of the predetermined time interval does not exceed the predetermined temperature, regardless of the temperature variation, said control means controls said power providing means so as not to stop the providing of electric power to said recording means.

2. An apparatus according to claim 1, wherein said recording means comprises temperature adjustment means for adjusting the temperature of said recording means.

3. An apparatus according to claim 2, wherein said temperature adjustment means includes a heater element.

4. An apparatus according to claim 1, further comprising:

recovery means for conducting a recovery process for recovering an ink ejection condition of said apparatus by discharging ink from at least some of the ink orifices of said recording means, wherein said control means further causes said recovery means to conduct the recovery process when the temperature detected at the end of the predetermined time interval does not exceed the predetermined temperature.

5. An apparatus according to claim 1, wherein said predetermined temperature is higher than a temperature at which said recording means can conduct normal recording by consecutively ejecting ink from all the orifices of said recording means.

6. An apparatus according to claim 1, further comprising:

carriage moving means for moving said recording means in a main scan direction different from an arrangement direction of the ink orifices.

7. An apparatus according to claim 1, further comprising movement means for moving a recording material in a sub-scan direction relative to said recording means after completion of a main scan by said recording means.

8. An apparatus according to any of claims 1–7, wherein each said energy generation element includes an electro-thermal converter and ejects the ink droplet using thermal energy generated by said electro-thermal converter.

* * * * *

UNITED STATES PATENT AND TRADEMARK OFFICE

CERTIFICATE OF CORRECTION

PATENT NO. : 5,502,469

DATED : March 26, 1996

INVENTOR(S) : KENJIRO WATANABE

It is certified that error appears in the above-identified patent and that said Letters Patent is hereby corrected as shown below:

On title page, item,

[54] TITLE

"TEMPERATURE" should read --TEMPERATURE CHANGE--.

COLUMN 1

Line 2, "TEMPERATURE" should read --TEMPERATURE CHANGE--.
Line 37, "quality," should read --quality.--.

COLUMN 4

Line 53, "T2" should read --ΔT2--.
Line 55, "T1" should read --ΔT1--.

COLUMN 5

Line 11, "last," should read --last--.
Line 43, "a" should read --an--.
Line 47, ".dot" should read --dot--.
Line 59, "Tamp 2" should read --Temp 2--.

UNITED STATES PATENT AND TRADEMARK OFFICE

CERTIFICATE OF CORRECTION

PATENT NO. : 5,502,469 Page 2 of 2

DATED : March 26, 1996

INVENTOR(S) : KENJIRO WATANABE

It is certified that error appears in the above-identified patent and that said Letters Patent is hereby corrected as shown below:

COLUMN 8

```
Line 21, "4,459,600.Further," should read
         --4,459,600.  Further,--.
Line 23, "No. 59-125670" should read --59-123670--.
Line 29, "full line" should read --full-line--.
Line 31, "allowed to print" should read
         --allows to be printed--.
Line 54, Close up right margin.
Line 55, Close up left margin.
```

Signed and Sealed this

Seventeenth Day of September, 1996

*Attest:*

Bruce Lehman

BRUCE LEHMAN

*Attesting Officer*

*Commissioner of Patents and Trademarks*